US005770550A

United States Patent [19]

Motson

[11] Patent Number: 5,770,550

[45] Date of Patent: Jun. 23, 1998

[54] SURFACTANTS

[75] Inventor: Harold Russell Motson, Stockton-on-Tees, United Kingdom

[73] Assignee: Imperial Chemical Industries PLC, Great Britain

[21] Appl. No.: 596,333

[22] PCT Filed: Aug. 19, 1994

[86] PCT No.: PCT/GB94/01815

§ 371 Date: Feb. 22, 1996

§ 102(e) Date: Feb. 22, 1996

[87] PCT Pub. No.: WO95/06096

PCT Pub. Date: Mar. 2, 1995

[30] Foreign Application Priority Data

Aug. 23, 1993 [GB] United Kingdom ..... 9317476

[51] Int. Cl.[6] ..... C11D 1/52; C11D 1/08; C11D 1/74

[52] U.S. Cl. ..... 510/238; 510/245; 510/272; 510/365

[58] Field of Search ..... 510/245, 238, 510/272, 365

[56] References Cited

U.S. PATENT DOCUMENTS 5,196,136 3/1993 Dishart et al. ..... 510/245

5,543,073 8/1996 Adamy et al. ..... 510/214

FOREIGN PATENT DOCUMENTS

| | | |
|---|---|---|
| A 0 107 199 | 5/1984 | European Pat. Off. . |
| A 0 384 605 | 8/1990 | European Pat. Off. . |
| A 1 568 623 | 5/1969 | France . |
| A 1465 700 | 2/1977 | United Kingdom . |
| A 2 131 820 | 6/1984 | United Kingdom . |
| WO A 87 00856 | 2/1987 | WIPO . |
| WO A 94 00508 | 1/1994 | WIPO . |

*Primary Examiner*—Jacqueline V. Howard

[57] ABSTRACT

Surfactants of the general formula (I): $Y.A^1.OC.(HR)C.C(HR^1).CO.A.(C_mH_{2m}O)_n.R^2$ or (II): $Y.A^1.OC.(HR)C.C(HR^1).CO.A.(C_mH_{2m}O)_n.C_pH_{2p}.A.CO.(HR^1)C.C(HR)CO.A^1.Y$; where R, $R^1$, $R^2$, A, $A^1$, n, m, Y and p have defined meanings are effective in single phase aqueous surfactant compositions with high electrolyte loading, especially of or including alkali, particularly for hard surface cleaning applications. These surfactants do not need hydrotropes to give stable single phase compositions even with high electrolyte loadings and are resistant to hydrolytic degradation e.g. by strong alkali in such compositions.

15 Claims, No Drawings

SURFACTANTS

This invention relates to surfactant compositions and in particular to aqueous surfactant compositions with a high electrolyte loading, in particular of alkali.

In the industrial cleaning of hard surfaces, such as those of metals, ceramics, glass and plastics, the cleaning processes typically involve spraying or dipping of the substrate into a cleaning fluid. In contrast to domestic cleaning, the use of mechanical surface rubbing is not usually used because it is difficult to use uniformly on other than very regularly shaped objects and is expensive. Energy may be supplied to the system to assist cleaning by agitation or the use of ultrasound. To compensate for the non-use of mechanical surface rubbing, the cleaning materials used are often much more aggressive than are used in domestic situations where contact with the user's skin is to be expected (or at least planned for even if inadvertent). Thus, aqueous industrial cleaning fluids can have high concentrations of electrolyte materials particularly acid materials or and especially alkali materials. When the electrolyte is an alkali it can be a moderately strong alkali such as soda ash (sodium carbonate) or it can be a strong alkali such as caustic soda (sodium hydroxide). A typical need for such cleaners is the removal of fatty, waxy or oily soils adherent to the substrate. The action of such materials may include chemical modification of the soiling material e.g. by alkali hydrolysis of fats to acids and alcohols. However, simple aqueous solutions of acids or alkalis are not good wetters of such hydrophobic materials and are thus relatively ineffective as cleaners. The inclusion of surfactant, usually synthetic surfactant, materials can improve the wetting power of the cleaning fluid and keep detached contaminants suspended away from the substrate being cleaned.

This invention is directed to this type of cleaning of hard surfaces using aqueous surfactant compositions with a high electrolyte loading, particularly where the electrolyte is or includes alkali.

Aqueous surfactant compositions with a high electrolyte loading of this general type are known as industrial cleaners and particularly as so-called 'hard surface cleaners'. They are used principally in the metal working industries, including the automotive industry and its support industries, in the cleaning of hard surfaces and the passivation, including metal degreasing, e.g. in spray cleaning plant. They are suitable for intermediate and final cleaning, including that of machined and otherwise shaped parts in engineering and assembly plants. In general, in such applications in the metal working industries such aqueous surfactant compositions are used to remove the majority of all surface contaminants arising from the working of the materials and to remove metal particles from machined or otherwise shaped parts arising from the working of the materials.

Industrial cleaning compositions of this type may be used in the metal working industries in spray cleaning plant. They are however also used in dipping and/or ultrasonic processes which are standard in these industries, including the automotive industry and its support industries, for the cleaning of hard surfaces and passivation, including metal degreasing.

Such known compositions for the cleaning of hard surfaces and passivation, including metal degreasing, are chiefly used on machined and otherwise shaped parts in engineering and assembly plants at ambient to moderately elevated temperatures, e.g. in the range of 15° to 80° C.

They are typically used at pH values of for example 4 to 13.5, and particularly 9 to 13.5 (by the inclusion of strongly alkaline hydroxides or carbonates, for example of sodium or potassium in the compositions), and in particular at less moderately elevated temperatures, e.g. nearer to 40° to 80° C., in use.

Known compositions of this type for the cleaning of hard surfaces and passivation, including metal degreasing, include those of such surfactants as alkyl phenol ethoxylates and fatty alcohol ethoxylates (also known as fatty alcohol polyethyleneglycol ethers) and sulphate and phosphate esters thereof; alkyl and alkaryl sulphonates; alcohol sulphates; sulphosuccinate mono- and di-esters; alkylene oxide block copolymers; and end carboxylated ethoxylates (ether carboxylates).

In such known classes of aqueous surfactant compositions, the high electrolyte loading, in general, includes at least one matrix material to resist soil redeposition, and/or builders, to enhance the surfactivity.

In one such class of known compositions of this type, including those used for metal degreasing in particular, much of the electrolyte loading also includes alkaline chemicals, such as alkali metal hydroxides or carbonates, for example those where the alkali metal cation is sodium or potassium.

In general, in such applications, known classes of aqueous surfactant compositions with a high electrolyte loading, in particular of alkali, tend to a poor stability in use and storage, in that the high electrolyte loading tends to cause the surfactant to phase separate from the composition. To prevent or inhibit this phase separation such known classes of surfactant compositions require the addition of a hydrotrope to solubilise the surfactant. Examples of compounds useful as hydrotropes include water miscible alkaryl sulphonates, generally with an alkali metal cation, e.g. sodium, such as sodium xylene and cumene sulphonates; alkyl phosphate esters, and alkyl polysaccharides (APS's).

In particular, in uses where it is required that the compositions are alkaline, particularly by the inclusion of strongly alkaline hydroxides or carbonates, such surfactant compositions tend to be sensitive to particular chemical factors such as hydrolysis of the surfactant, and consequent loss of surfactivity. This disadvantage of known aqueous surfactant compositions with a high electrolyte loading is of course inherent in the surfactant, and the above loss of surfactivity cannot be remedied by known surfactant composition additives, such as hydrotropes.

PCT Application No PCT/GB 93/01335 published as No WO 94/00508 A describes a class of surfactants based on alkyl and/or alkenyl substituted succinic acid derivatives, particularly esters and various uses for these compounds for example as emulsifying agents.

We have now found that compounds such as those described in WO 94/00508 A are useful in aqueous surfactant compositions with a high electrolyte loading, in particular where the electrolyte is or includes alkali, such as formulations which are used in industrial cleaning, in particular in the cleaning of hard surfaces, including metal degreasing. Using these surfactants the aqueous surfactant compositions with a high electrolyte loading can be made as a single phase and do not suffer from the above described disadvantage of known high electrolyte surfactant compositions, in particular, the compositions do not require the use of surfactant composition additives, such as hydrotropes, and the surfactants are stable in the compositions and thus do not suffer the disadvantages that are inherent in conventional surfactant used in such compositions.

In this invention the surfactants are polyoxyalkylene derivatives of vic-dicarboxylic acids which have good stability in use and storage, where it is required to be resistant to phase separation and in particular chemical factors such as hydrolysis of the surfactant.

Accordingly, the present invention provides a single phase aqueous surfactant composition with a high electrolyte loading, in particular of alkali, and which contains at least one compound of the formula (I) or (II):

$$Y.A^1.OC.(HR)C.C(HR^1).CO.A.(C_mH_{2m}O)_n.R^2 \quad (I)$$

where one of R and $R^1$ is $C_6$ to $C_{22}$ alkenyl or alkyl and the other is hydrogen;

A and $A^1$ are each independently —O— or —$NR^4$—; where $R^4$ is hydrogen or $C_1$ to $C_6$ alkyl, particularly methyl or ethyl;

n is 2 to 100 (and as it is an average it may be non-integral);

m is 2 or 3 (and may vary along the polyoxyalkylene chain);

$R^2$ is hydrogen or $C_1$ to $C_6$ alkyl;

Y is a cation forming group, particularly a hydrogen or an alkali metal, especially sodium or potassium, atom or ammonium (especially $NH_4$, amine ammonium or alkanolamine ammonium) group; or Y is a $C_1$ to $C_6$ alkyl group or a group of the formula $(C_mH_{2m}O)_n.R^2$ where m, n and $R^2$ are independently as defined above; or $$Y.A^1.OC.(HR)C.C(HR^1).CO.A.(C_mH_{2m}O)_n.C_pH_{2p}.A.CO.(HR^1)C.C(HR)CO.A^1.Y \quad (II)$$

where:

n, m and each pair of R and $R^1$, A, $A^1$ and Y are independently as defined above; and p is 2 or 3.

Preferred surfactant compositions are characterised by consisting substantially of an aqueous solution of at least one electrolyte at high loading and at least one compound of the formula (I) or (II).

The present surfactant compositions with a high electrolyte loading, in particular of alkali, remain a single phase surfactant composition without the need for the addition of a hydrotrope to solubilise the surfactant, and prevent phase separation of the surfactant from the composition due to the high electrolyte loading, in particular of alkali;

a) have good chemical stability and resistance to chemical attack such as hydrolysis of the surfactant for example the compositions are alkaline e.g. at a pH of from 9 to 13.5; and particularly from 12.5 to 13.5, especially where the source of alkalinity is a strong alkali e.g. alkali metal, hydroxides or carbonates.

b) exhibit a high cleaning capacity and excellent wetting properties in relation to treated substrates, such as iron, steels, including stainless, nickel and chrome steels, copper, brasses, bronzes, zinc, glass, ceramics and plastics, and (with low or non-alkaline compositions) aluminium, silumin and duralumin;

c) facilitate good stain free run off of the cleaning composition from, and leave no dullness on, the treated substrate; and d) exhibit emulsification of oils and greases that are not self emulsifying which are not usually readily emulsified in hard surface cleaning, and in particular metal degreasing, even by known industrial cleaning compositions with a high loading, in particular of alkali.

The compositions of this invention of this type, in particular those with a high loading of alkali, are thus highly suitable where they are required to have a good stability in use and storage. Examples of such uses include the industrial cleaning of hard surfaces, in particular metal degreasing, e.g. in cleaning plant in the metal working industries, including the automotive industry and its support industries.

Preferred half esters of vic-dicarboxylic acids include those of WO 94/00508 A.

The surfactant composition of the invention will often use half esters of vic-dicarboxylic acids which contain anionic groups and/or in particular groups which are ionisable to form anions.

The half ester of a vic-dicarboxylic acid is desirably a derivative of succinic acid and particularly a hydrocarbyl substituted, especially alkyl or and particularly desirably alkenyl substituted succinic acid. The hydrocarbyl substituent is desirably a $C_6$ to $C_{22}$, particularly a $C_8$ to $C_{18}$ and especially a $C_{10}$ to $C_{16}$ e.g. a $C_{12}$ or $C_{14}$, hydrocarbyl group especially an alkyl or and particularly desirably an alkenyl group.

Typically, when such compounds are used, when either A or $A^1$ is —O— the total number of carbon atoms in the groups R, $R^1$ and any groups $R^2$ and $R^3$ is at least 13, and is desirably 13 to 50.

The ester group in the half ester is a polyalkylene oxide group, particularly one made up from ethyleneoxy and/or propyleneoxy groups. Where both such groups are present the copolymer chain can be block or random. Desirably the polyalkylene oxide group, is a polyethyleneoxy group. The number of allkylene oxide residues in the polyalkylene oxide group is desirably from 2 to 100 particularly 3 to 50 and especially 2 to 25. Where the polyalkylene oxide group is a polyethyleneoxy group (polyethylene glycol—PEG) it is desirably a PEG 150 to 2000, especially a PEG 200 to 100 group. The polyalkylene oxide group can be terminated with a hydrogen atom or a lower alkyl group, particularly a $C_1$ to $C_6$ group especially a methyl, ethyl, propyl, n- or i-propyl, or butyl e.g. i-butyl or t-butyl group.

Particularly useful compounds are those of the formula (Ia):

$$Y.OOC.(HR)C.C(HR^1).COO.(CH_2CH_2O)_n.R^2 \quad (Ia)$$

where one of R and $R^1$ is a $C_8$ to $C_{18}$ particularly a $C_{10}$ to $C_{16}$ e.g. a $C_{12}$ or $C_{14}$, alkyl or especially alkenyl group and the other is hydrogen;

n is from 3 to 50;

$R^2$ is hydrogen or a $C_1$ to $C_6$ alkyl group; and

Y is a hydrogen or alkali metal atom or an ammonium group.

Bis-half esters can also be used. These compounds are similar to the half esters described above except that the polyalkylene oxide group has a half ester group at each end. Such compounds can particularly be of the formula (IIa):

$$Y.OOC.(HR)C.C(HR^1).COO.(CH_2CH_2O)_n.OC.C(HR^1).C(HR)COO.Y \quad (IIa)$$

where n, each pair of R and $R^1$, and Y are independently as defined above for the formula (Ia).

Specifically when used in industrial cleaning, in particular in metal degreasing, particularly preferred vic-dicarboxylic acid polyalkyleneoxy half ester surfactants of this type include mono- and bis-esters of formula (I) or (II) respectively in which the group R or $R^1$ which is not hydrogen preferably has 8 to 20 carbon atoms. Particular esters of this type include those in which this group has 6 to 18, e.g. 12 to 14 carbon atoms, and in particular where it is an alkenyl group.

Preferred such vic-dicarboxylic acid polyalkyleneoxy half esters also include those of the formula (I) in which the group $(C_mH_{2m}O)_nR^2$ is an alkylene oxide (block)(co-) polymer in which n is preferably 7 to 13 and m is 2 and/or 3.

The composition will often includes those materials conventional in compositions formulated with a high electrolyte loading, in particular of alkali, for use in industrial cleaning, as described above, except of course for any hydrotrope which is unnecessary to solubilise the surfactant. The composition will thus typically comprise in such applications known classes of matrix materials/soil redeposition inhibitors.

One such class of known materials of this type includes one or more phosphates, orthophosphates, polyphosphates, silicates, metasilicates, citrates, gluconates, phosphonic acids and phosphonoalkane carboxylic acids, and water soluble salts thereof generally with an alkali metal cation e.g. sodium or potassium. Known materials of this type including 1-hydroxyethane-1,1-diphosphonic acid and 2-phosphonobutane-1,2,4-tricarboxylic acid and water soluble salts thereof.

The composition will also typically comprise in such applications known classes of builders/sequestering agents, to enhance the surfactivity. One such class of known materials of this type includes one or more N-carboxylated polyamine salts, e.g. EDTA, NTA, generally with an alkali metal cation; nitrilocarboxylic acids, such as the preferred nitrilotriacetic acid; polycarboxylic acids, such as the preferred citric acid; polyacrylic acids; and/or water soluble salts thereof, such as those with an alkali metal cation e.g. sodium or potassium; and gluconates and heptonates generally of an alkali metal.

The quantity of the builder/sequestering agent to enhance the surfactivity will depend on the hardness and heavy metal cation content of the electrolyte loading both before and in particular after contact with any metal substrate ionisable to form cationic species. Examples of the latter include iron and steels, including stainless, nickel and chrome steels, copper, brasses, bronzes, zinc, aluminium, silumin and duralumin.

In general, in the present classes of aqueous surfactant compositions preferred such further components are those conventionally preferred in industrial cleaning with a composition with high electrolyte loading, in particular of alkali, as used in particular in metal degreasing.

The single phase surfactant composition with a high electrolyte loading of this invention, may have a pH value within a wide range, for example 3 (acid) to 13.5 (alkaline), for example 9 to 13.5, and specifically 12.5 to 13.5. The extremes of the wider pH range are where factors such as surfactant hydrolysis is often a problem for conventional known surfactant compositions with a high electrolyte loading, e.g. of an acid, such as phosphoric acid, and in particular of alkali, as used in industrial cleaning, in particular in metal degreasing. This is not the case for the single phase aqueous surfactant composition with a high electrolyte loading, in particular of alkali, of the present invention.

Other possible additives in the aqueous surfactant compositions with a high electrolyte loading to which this invention relates include non-surfactants such as corrosion inhibitors, stabilisers, materials which are conventionally useful as anti foam agents in aqueous surfactants, surface cleaning organic solvents and biocides such as antimicrobials. One class of known corrosion inhibitors, suitable for practically all the relevant substrate materials may be so treated, such as iron and steels, including stainless, nickel and chrome steels, copper, brasses, bronzes, bronzes, aluminium, silumin and duralumin, includes straight chain or branched alkanecarboxylic acids and water soluble salts thereof e.g. with an alkali metal cation e.g. sodium or potassium, or an alkanolammonium cation, materials of this type, including in particular water soluble alkanolammonium salts of straight chain or branched alkanecarboxylic acids which acids comprise 8 to 11 carbon atoms.

Especially when the composition is intended for use in spray cleaning plant it will typically include an anti foam agent. Compounds which are conventionally useful as anti foam agents in aqueous surfactant formulated with a high electrolyte loading, in particular of alkali, for use in industrial cleaning, may be used. One such class of known anti foam agents is the commercially available water soluble silicone oils.

The composition, in particular when used in metal degreasing, may also comprise one or more known classes of water insoluble organic solvents, to aid the surface cleaning. One such class of surface cleaning solvents includes hydrocarbons, preferably those having 5 to 18 carbon atoms and mixtures thereof, and chlorinated hydrocarbons, preferably those having 1 to 14 carbon atoms and mixtures thereof.

The aqueous surfactant compositions to which this invention relates, may be produced by conventional mixing of the components in any order used conventionally for industrial cleaning formulations with a high electrolyte loading. Examples include adding the components to water and/or any other solvents, and stirring until the product is homogeneous, taking the usual care in particular in the case of the addition of alkali components to water.

Accordingly, the invention includes a process for producing a single phase aqueous surfactant composition with a high electrolyte loading of the first aspect of the present invention which comprise the conventional mixing of the components in any feasible order.

The surfactant compositions of this invention are formulations which are principally useful in the metal working industries, including the automotive industry and its support industries. They are then typically used in the cleaning of hard surfaces and passivation, including metal degreasing and the removal of other contaminants arising from the working of the materials. However, they also find applications in other industries, e.g. the foodstuff, animal feed, pharmaceutical, transport and photographic industries, and in health care. The aqueous surfactant compositions may then be used to remove contaminants other than cooling lubricants, slushing oils, machining oils, drawing aids, pigments etc. Such aqueous surfactant compositions are thus also useful in the removal from the relevant substrate such as steels, including stainless, nickel and chrome steels, copper, brasses, bronzes, zinc, glass, ceramics and plastics, of materials, such as animal and vegetable oils and greases including those not usually readily emulsified in cleaning of hard surfaces; carbon such as graphite; animal and vegetable matter, such as blood, albumen and starch and starch derivatives; dust; and dyestuffs.

Corresponding hard surfaces to which the aqueous surfactant compositions of this invention may be applied outside the metal working industries include e.g. autoclaves, vessels, instruments and filter press components used conventionally in such industries; floors, walls and furniture surfaces of hospitals, smoke chambers, abattoirs and food factories and shops; and road and rail tunnels. Some of the contaminants in other industries, e.g. the foodstuff, animal feed, pharmaceutical photographic industries, may be less resistant than the examples from the metal working industries, including the automotive industry contaminants arising from the working of materials, such as cooling lubricants, slushing oils, given above. The concentration of the components of the composition will be chosen to meet these requirements.

Typically the compositions of the invention will be formulated initially at relatively high concentrations and will be diluted for use. In such dilutable formulations the amounts of the various components described above (in addition to the water) will typically be as follows (all by weight of the total composition):

- surfactant of the formula (I) or (II) from 1 to 40% , preferably 2 to 20, and in particular 5 to 15%;
- matrix materials and/or builder(s) 1 to 40, particularly 5 to 10%;
- alkali 0 to 10, particularly 1 to 5%;
- water insoluble organic solvents (when present) 1 to 40, particularly 5 to 15%;
- other components e.g. corrosion inhibitors, stabilisers, anti foams, biocides etc. in an amount (usually less than 1%) as needed to be effective.

Such dilutable formulations of the invention are also typically stable against phase separation and destructive hydrolysis of the surfactant as the compositions at end use concentrations.

In practical use such a dilutable formulation will usually be mixed with water to give an end use composition having a concentration of surfactant typically in the range 0.05 to 2, more usually 0.1 to 0.5, % by weight of the total composition. As indicated above, the concentration will depend on the particular end use. In diluted form, the composition will usually contain at least 90% and may contain up to 99% by weight of water, but more usually form 93 to 97% water.

The invention specifically includes both a dilutable surfactant formulation and the formulation diluted ready for use.

The aqueous surfactant compositions of this invention may also be used in ultrasonic cleaning of hard surfaces and passivation. Examples include such applications in the metal working industries, including the automotive industry and its support industries, in the ultrasonic cleaning of hard surfaces, including ultrasonic metal degreasing in the case of the more concentrated formulations.

The invention includes a method of cleaning a surface that comprises contacting the surface to a surfactant composition of the invention. The surface may be so contacted by immersion e.g. dipping optionally with the use of ultrasonic energy, spraying or other means.

The following Examples illustrate the invention. All parts and percentages are by weight unless otherwise specified.

The surfactants used in the Examples were as shown in Table 1 below. Those which were used to make compositions of this invention were of the formula: HOOC.(HR)C.C($HR^1$).COO.($CH_2$.$CH_2O$)$_n$.$R^2$ where one of R and $R^1$ is an alkenyl or alkyl group as indicated in Table 1 and the other is hydrogen; and n and $R^2$ are as indicated in Table 1 below. Surfactants 1 to 11 are used in compositions of the invention and CA and CB are used in control compositions.

The surfactants 1 to 11 were formulated into corresponding aqueous surfactant compositions of this invention with a high electrolyte loading, including alkali. Control surfactants A and B were formulated into corresponding control aqueous surfactant compositions with, of course, the addition of a hydrotrope which is necessary to solubilise the surfactant. This was effected by the simple mixing process for producing a single phase aqueous surfactant composition with a high electrolyte loading described above.

The compositions were formulated as:

| | % by weight |
|---|---|
| Surfactant | 7.6 |
| Alkali (sodium hydroxide) | 1.1 |
| Builders (trisodium phosphate) | 1.5 |
| (sodium metasilicate) | 5.3 |
| Sequestering Agent (disodium EDTA) | 4.6 |
| Hydrotrope (sodium cumene sulphonate) (in compositions A2 and B2 only) | 3.8 |
| Water | to 100 |

The visible properties of the compositions of the invention and the control compositions are set out in Table 2 below. Visual properties were assessed on the Appearance of the composition at 20° C. (in the Table given as 'Appear': S=single phase, T=two phase and C=clear) and Cloud Point (°C.).

The surfactant compositions were tested for their efficacy in metal degreasing. These compositions were used in the test applications both diluted and undiluted in aqueous solution in the proportion of 3% w/w (giving an effective concentration of the surfactant of about 0.2%). The diluted and undiluted compositions were tested in the following metal degreasing test in a Zeltec Vista Color apparatus:

Half the surface of a standard metal substrate (stainless steel) coupon was coated with a standard greasy dirt at 60° C. The dirt was made up by mixing the following components:

| | parts by weight |
|---|---|
| Stearic acid | 15 |
| Oleic acid | 15 |
| Trex | 30 |
| Lubricating oil (e.g. Shell 15W/50) | 25 |
| Octadecanol | 8 |

homogenising the mix and storing it at 75° C. for 16 hours before application to the surface of the coupon. The stainless steel coupon coated with the standard greasy dirt was allowed to cool to 20° C. and weighed. The coupon was then immersed into the test composition at a known temperature e.g. in the range 15° to 80° C., and then agitated with a helicoidal motion, for a known time, and the cleanliness of the immersed coupon after agitation was assessed by means of the recorded weight loss (from which the % Grease Removal was calculated) and visually to obtain an assessment of Surface Finish which was recorded on a scale from 0=fully soiled to 5=completely clean.

The performance of the relevant compositions and solutions in metal degreasing as shown by contact with a stainless steel substrate in the test applications described above is shown in are set out in Tables 2 and 3 below.

The results included in Table 2 are on compositions diluted at 3% with the test at 20° C. and the results given in Table 3 are on undiluted compositions tested at 40° C. and at 40° C. after storage of the compositions at 40° C. for 1 month.

TABLE 1

| Surfactants Used | | | |
|---|---|---|---|
| Surfactant No | R/R$^1$ | n | R$^2$ |
| 1 | $C_8H_{15}$ | 9 | Butyl |
| 2 | $C_{12}H_{23}$ | 9 | H |
| 3 | $C_{12}H_{23}$ | 3.5 | Methyl |
| 4 | $C_{12}H_{23}$ | 9 | Butyl |
| 5 | $C_{12}H_{23}$ | 17 | Methyl |
| 6 | $C_{12}H_{23}$ | 11 | Butyl |
| 7 | $C_{12}H_{23}$ + $C_{14}H_{27}$ | 3.5 | Methyl |
| 8 | $C_{12}H_{23}$ + $C_{14}H_{27}$ | 9 | Butyl |
| 9 | $C_{14}H_{27}$ | 3.5 | Methyl |
| 10 | $C_{16}H_{31}$ | 9 | Butyl |
| 11 | $C_{16}H_{31}$ | 11 | Butyl |
| CA | Nonylphenol (ethoxylate)$_9$ | | |
| CB | $C_9$ to $C_{11}$ alcohol(ethoxylate)$_9$ | | |

TABLE 2

| Surfactant | Appear | | Cloud Point (°C.) | Surface Finish | Grease Removal % |
|---|---|---|---|---|---|
| 1 | S | C | 80 | 3 | 96.52 |
| 2 | S | C | >100 | 3 | 93.95 |
| 3 | S | C | >100 | 4 | 99.56 |
| 4 | S | C | >100 | 4 | 99.73 |
| 5 | S | C | 97 | 3 | 98.05 |
| 6 | S | C | 22 | 3 | 96.84 |
| 7 | S | C | >100 | 4 | 98.67 |
| 8 | S | C | >100 | 3 | 94.87 |
| 9 | S | C | — | 3 | 93.17 |
| 10 | S | C | >100 | — | — |
| 11 | S | C | 26 | — | — |
| A1 | T | | — | — | — |
| A2 | S | | 33 | 4 | 97.4 |
| B1 | T | | — | — | — |
| B2 | S | | 28 | 4 | 99.7 |

TABLE 3

| Composition | Surface Finish | Grease Removal % |
|---|---|---|
| | initial test | |
| 4 | 4 | 98.05 |
| 5 | 3 | 96.20 |
| 7 | 4 | 99.73 |
| 8 | 3 | 98.67 |
| | stored (40° C., 1 month) | |
| 4 | 3 | 94.2 |
| 5 | 4 | 96.20 |
| 7 | 4 | 100.0 |
| 8 | 3 | 95.05 |

I claim:

1. A single phase aqueous surfactant composition with a high electrolyte loading including alkali comprising from 1 to 40% by weight of the total composition of at least one surfactant compound of the formula (I) or (II):

$$Y.A^1.OC.(HR)C.C(HR^1).CO.A.(C_mH_{2m}O)_n.R^2 \quad (I)$$

where one of R and R$^1$ is $C_6$ to $C_{22}$ alkenyl or alkyl and the other is hydrogen;

A and A$^1$are each independently —O— or —NR$^4$—; where R$^4$ is hydrogen or $C_1$ to $C_6$ alkyl;

n is 2 to 100;

m is2or3;

R$^2$ is hydrogen or $C_1$ to $C_6$ alkyl;

Y is a cation forming group, a $C_1$ to $C_6$ alkyl group or a group of the formula $(C_mH_{2m}O)_n.R^2$ where m, n and R$^2$ are independently as defined above;

or $$Y.A^1.OC.(HR)C.C(HR^1).CO.A.(C_mH_{2m}O)_n.C_pH_{2p}.A.CO.(HR^1)C.C(HR)CO.A^1.Y \quad (II)$$

where:

n, m and each R, R$^1$, A, A$^1$ and Y are independently as defined above; and p is 2 or3;

in which from 1 to 40% by weight of the total composition of matrix materials and/or builder(s); and from 1 to 10% by weight of the total composition of alkali.

2. A surfactant composition as claimed in claim 1 in which the compound of the general formula (I) is of the formula (Ia):

$$Y.OOC.(HR)C.C(HR^1).COO.(CH_2CH_2O)_n.R^2 \quad (Ia)$$

where one of R and R$^1$ is a $C_{10}$ to $C_{16}$ alkenyl group and the other is hydrogen;

n is from 3 to 50;

R$^2$ is hydrogen or a $C_1$ to $C_6$ alkyl group; and

Y is a hydrogen or alkali metal atom or an ammonium group.

3. A surfactant composition as claimed in claim 2 in which R$^2$ is a $C_1$ to $C_6$ alkyl group.

4. A surfactant composition as claimed in claim 1 in which the compound of the general formula (II) is of the formula (IIa):

$$Y.OOC.(HR)C.C(HR^1).COO.(CH_2CH_2O)_n.OC.C(HR^1).C(HR)COO.Y \quad (IIa)$$

where:

one of each pair of R and R$^1$ is independently a $C_{10}$ to $C_{16}$ alkenyl group and the other is hydrogen;

n is from 3 to 50; and each Y is independently a hydrogen or alkali metal atom or an ammonium group.

5. A surfactant composition as claimed in any one of claims 1 to 4 in which the pH of the composition is from 9 to 13.5.

6. A surfactant composition as claimed in any one of claims 1 to 4 which additionally includes one or more of soil redeposition inhibitors, sequestering agents, corrosion inhibitors, stabilisers, anti foam agents, surface cleaning organic solvents and anti-microbials.

7. A surfactant composition as claimed in claim 6 which has a pH of from 9 to 13.5.

8. A single phase aqueous surfactant composition which comprises a surfactant composition as claimed in claim 1 which is diluted with water so that it contains contains from 90 to 99% by weight of water.

9. A single phase aqueous surfactant composition with a high electrolyte loading including alkali which comprises:

from 1 to 40% by weight of the total composition of a compound of the formula (Ia):

$$Y.OOC.(HR)C.C(HR^1).COO.(CH_2CH_2O)_nR^2 \quad (Ia)$$

where one of R and $R^1$ is a $C_{10}$ to $C_{16}$ alkenyl group and the other is hydrogen;

n is from 3 to 50;

$R^2$ is a $C_1$ to $C_6$ alkyl group; and

Y is a hydrogen or alkali metal atom or an ammonium group; in which from 1 to 40% by weight of the total composition of matrix materials and/or builder(s); and from 1 to 10 % by weight of the total composition of alkali.

10. A surfactant composition as claimed in claim 9 in which the pH of the composition is from 9 to 13.5.

11. A surfactant composition as claimed in claim 10 which additionally includes one or more of soil redeposition inhibitors, sequestering agents, corrosion inhibitors, stabilisers, anti foam agents, surface cleaning organic solvents and anti-microbials.

12. A method of cleaning a surface comprising contacting the surface with a surfactant composition as claimed in any one of claims 1 to 4.

13. A method as claimed in claim 12 in which the cleaning is carried out by spraying the surfactant composition onto the surface being cleaned.

14. A method as claimed in claim 12 in which the cleaning is carried out by immersing the surface being cleaned in the surfactant composition.

15. A method as claimed in claim 12 in which the surface being cleaned is additionally subject to ultrasonic energy.

* * * * *